US009844974B2

(12) United States Patent
McCurdy

(10) Patent No.: US 9,844,974 B2
(45) Date of Patent: Dec. 19, 2017

(54) PEN PLANT

(71) Applicant: Sandra Starr McCurdy, Arden, NC (US)

(72) Inventor: Sandra Starr McCurdy, Arden, NC (US)

( * ) Notice: Subject to any disclaimer, the term of this patent is extended or adjusted under 35 U.S.C. 154(b) by 17 days.

(21) Appl. No.: 15/297,496

(22) Filed: Oct. 19, 2016

(65) Prior Publication Data

US 2017/0050461 A1 Feb. 23, 2017

Related U.S. Application Data

(63) Continuation-in-part of application No. 14/813,726, filed on Jul. 30, 2015.

(51) Int. Cl.
*B43K 29/00* (2006.01)
*A41G 1/00* (2006.01)

(52) U.S. Cl.
CPC ..... *B43K 29/00* (2013.01); *A41G 1/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,678,206 | A * | 7/1987 | Leahan | B42D 5/006 281/44 |
| D328,310 | S * | 7/1992 | Yoshinaga | D11/117 |
| 6,234,699 | B1 * | 5/2001 | Brode | B43K 7/005 401/195 |
| 6,773,188 | B1 * | 8/2004 | Tamaye | B43K 7/005 401/131 |
| 8,011,846 | B1 * | 9/2011 | Bates | B43K 29/00 401/195 |
| 2015/0151564 | A1 * | 6/2015 | Jones | B43K 7/005 401/208 |

* cited by examiner

*Primary Examiner* — David Walczak

(57) ABSTRACT

An artificial house plant, hereby named 'Pen Plant', made from artificial wired plants wherein each individual shoot comprises of a ballpoint pen arranged in a pot or vase to realistically resemble a house plant. Floral tape may be used to create the illusion of the extension of the plants shoot or root. Pieces of the plant may be used to decorate vase or pot with, in some cases and as shown below, a ribbon.

1 Claim, 13 Drawing Sheets

PEN PLANT

CONTINUATION

This is a continuation-in-part of my earlier application, Ser. No. 14/813,726, Filed on Jul. 31, 2015.

DESCRIPTION

A useful, unique and classy way to decorate a home, business, hotel, or restaurant, while reducing pen replacement cost. Decorate a desk at home or office, make pens available for customers with staying power thus reducing overhead, resell in a flower shop, gift shop, place a small arrangement on a restaurant table, or offer guests a take home item in hotel rooms to increase profit. Made from wired artificial house plants, and ball point pens. A practical, low maintenance, decoration or gift.

FIELD OF INVENTION

This invention relates generally to artificial house plant designs, and, more particularly, the invention relates to wired artificial house plant designs featuring a ball point pen incorporated into each shoot to create a realistic looking house plant with purpose.

BACKGROUND OF INVENTION

Description of the Prior Art

There is no prior art relating to the incorporation of a pen into an artificial house plant, but several designs for a faux flower incorporating a pen into its stem are present. Among these are:

U.S. Design Pat. No. 20150151564 to Katrina Jones shows floral arrangement featuring a ball point pen incorporated into the stem of some flowers to create a designated floral arrangement.

U.S. Design Pat. No. D328,310 to Shigeo Yoshinaga shows a retractable ball point pen having a flower attached to its distal end.

U.S. Pat. No. 4,678,206 to Daniel P. Leahan describes a combination pen and note pad holder with the pad being formed in the shape of an open flower blossom and the pad adhered to a base member having the same flower shaped peripheral design.

U.S. Pat. No. 6,773,188 to Pia Tamaye describes flower pot pens wherein a pen holder in the form of a potted plant has a housing resembling a plant pot having a filler supporting potted plant material such as pebbles with a receptacle extending into the filler forming a cavity for the insertion therein of a pen and wherein the distal end of the pen has a decorative element such as a flower.

None of these references describe the present invention.

SUMMARY OF INVENTION

It is an object of the present invention to provide an artificial house plant wherein the shoots of the plant incorporate a pen, and are placed into a vase or pot with beans.

It is an object of the present invention to provide a useful, unique, an artificial, practical, low maintenance house plant featuring a ball point pen incorporated into each wired and flexible shoot, to create a realistic looking functional house plant with purpose.

BRIEF DESCRIPTION OF DRAWINGS

The invention can be better understood in the detailed description while referencing the following.

DETAILED DESCRIPTION OF INVENTION'S PROCESS

This is a continuation-in-part of my earlier application, Ser. No. 14/813726, Filed on Jul. 31, 2015.

Figure 1:
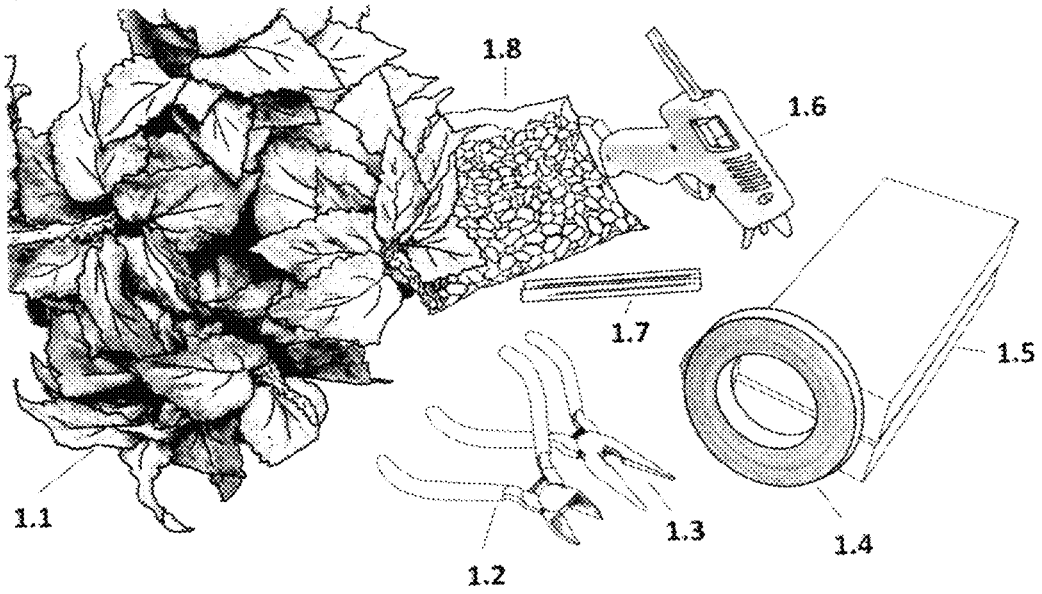
FIG. 1—A perspective view of the materials used in creating the 'Pen Plant'
Figure 2:
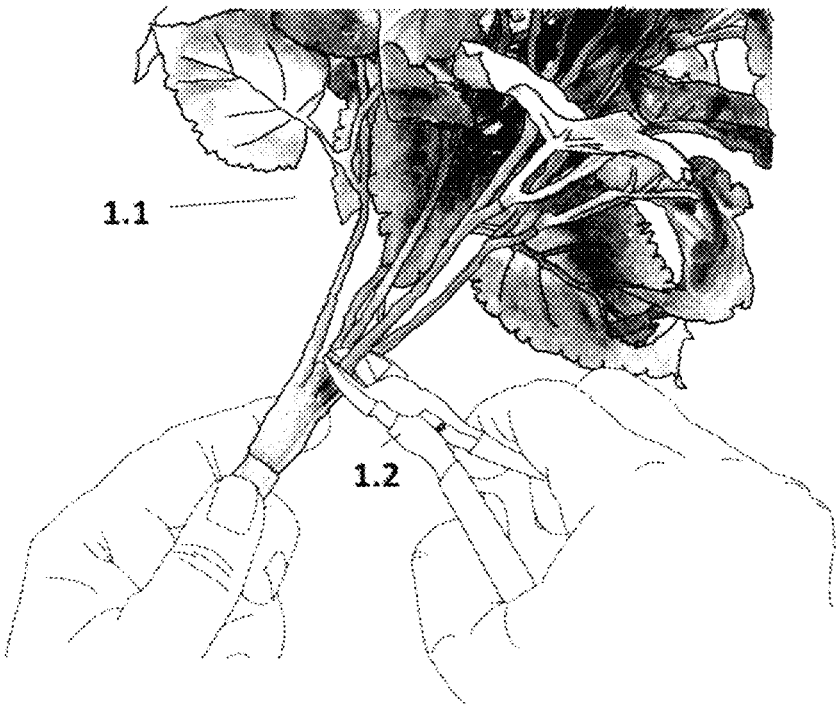
FIG. 2—A perspective view of step one of process

FIG. 1—Materials consist of (1.1) Varied species of wired artificial plants, (1.2) Wire cutters for cutting wired artificial plant, (1.3) Needle nose pliers sometimes used in separating shoots of plant and stripping areas too large to insert into pen, (1.4) Floral tape for securing wired plant to pen after glued, (1.5) Ball point pens, (1.6) Glue gun, (1.7) Glue, (1.8) Beans to create illusion of soil FIG. 2—Step one: Using (1.2) Wire cutters, and (1.3) Needle nose pliers when needed, separate shoots of (1.1) plants by cutting and sometimes stripping to expose wires on thicker species.

Figure 3:
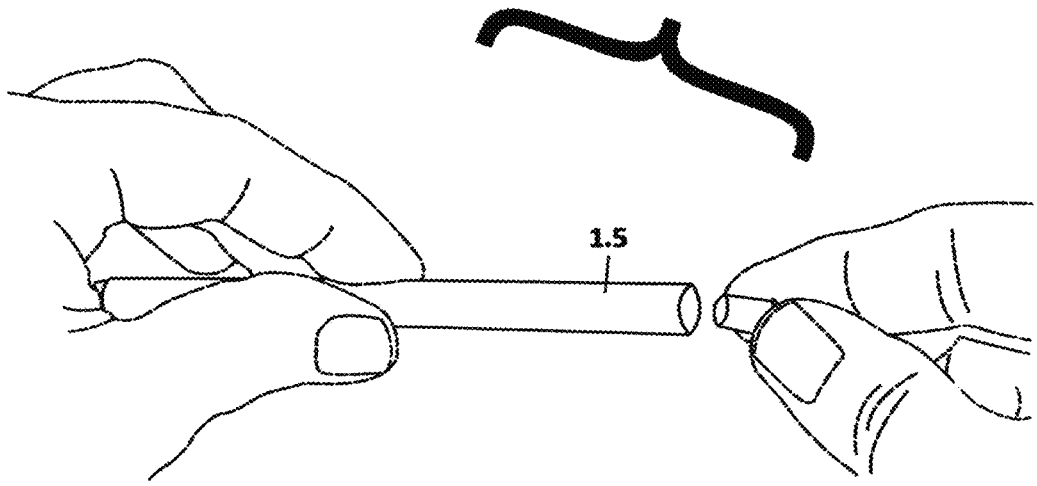
FIG. 3—A perspective view of step two of process

FIG. 3—Step two: Remove end caps of (1.5) Ball point pens.

Figure 4:
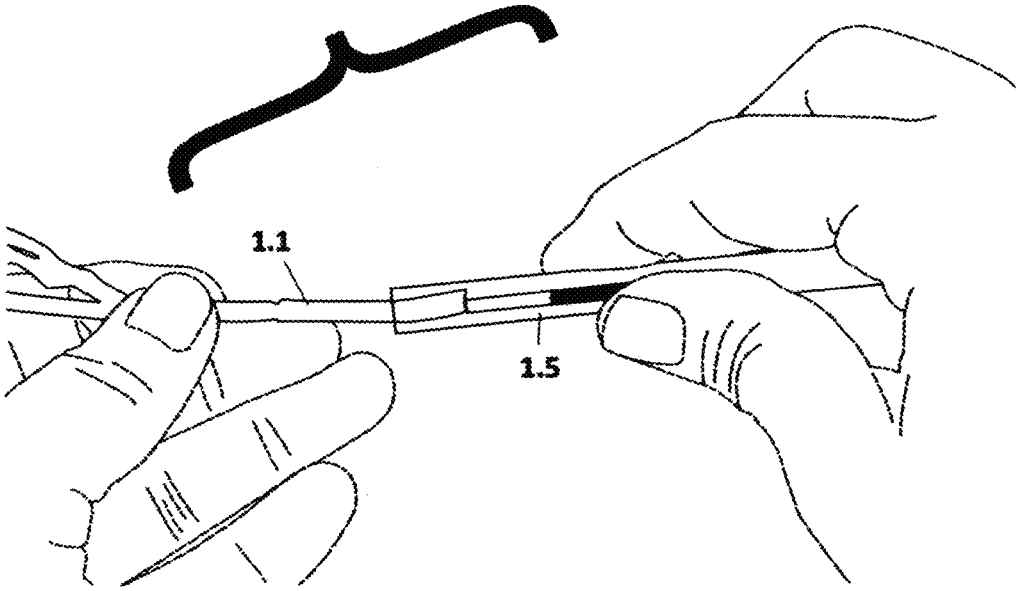
FIG. 4—A perspective view of step three of process

FIG. 4—Step three: Measure end of (1.1) Wired artificial plant shoot by inserting the shoot into the open end of the (1.5) Ball point pen.

Figure 5:
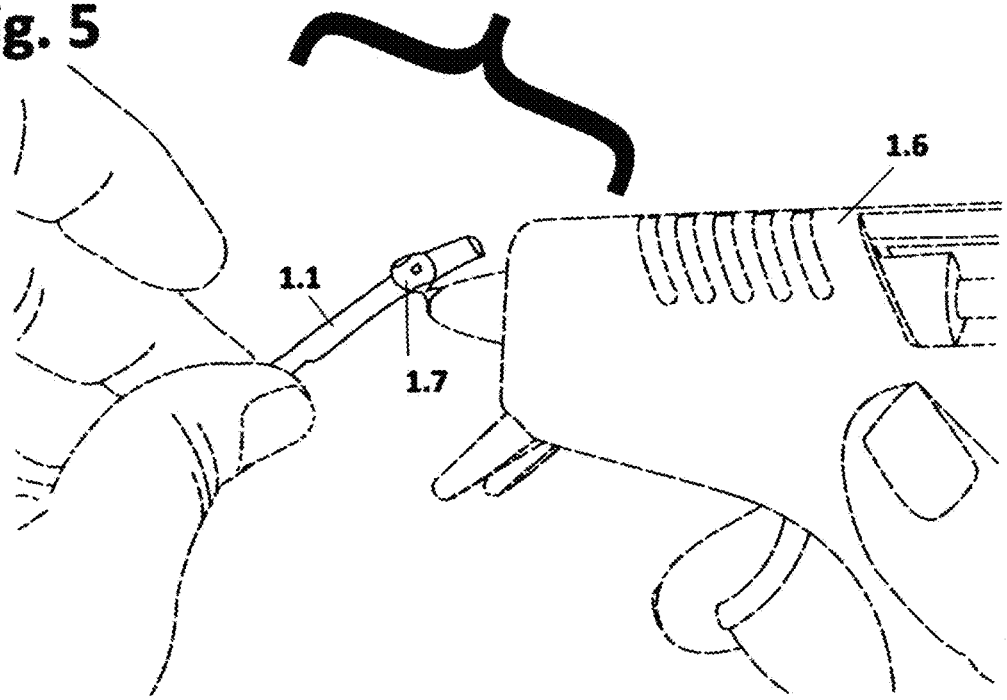
FIG. 5—A perspective view of step four of process

FIG. 5—Step four: Using (1.6) Glue gun, squeeze a sufficient amount of (1.7) Glue around the (1.1) wired plant shoot just below the measure line to ensure glue will be pushed into the opened end of the pen and will create a quarter of an inch seal at the top for stability.

Figure 6:
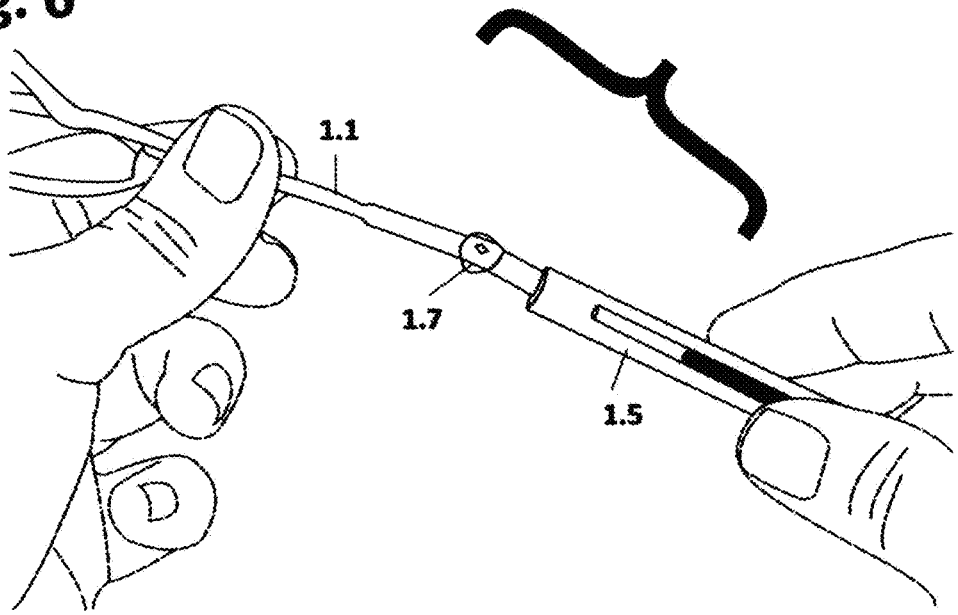
FIG. 6—A perspective view of step five of process

FIG. 6—Step five: Insert (1.1) plant shoot with (1.7) glue into the open end of the (1.5) ball point pen. Add more (1.7) glue (not pictured) as needed to secure effectively and hold (1.1) plant shoot in place until glue hardens slightly.

Figure 7:
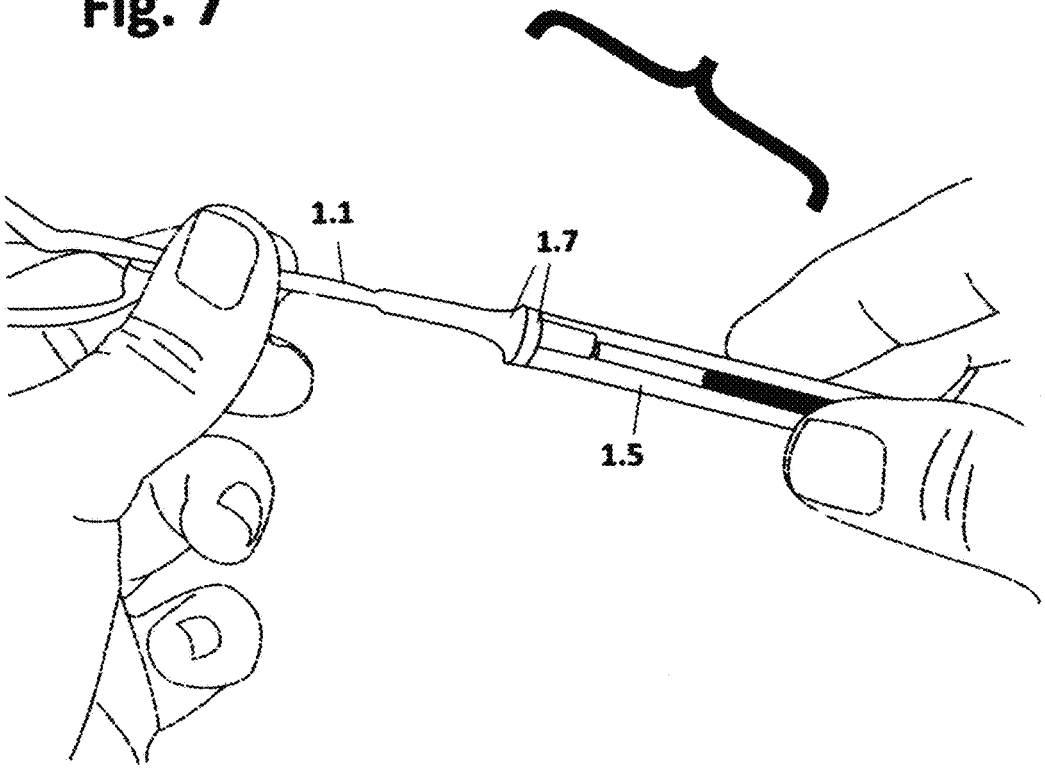
FIG. 7—A perspective view of step six of process

FIG. 7—Step six: Use side of (1.6) glue gun (not pictured) to smooth glue and blend it into the (1.1) plant's shoot. Hold until stable. Completed process pictured showing (1.1) Wired plant, attached to (1.5) ball point pen with (1.7) glue that has been blended with (1.6) glue gun as described above.

Figure 8:
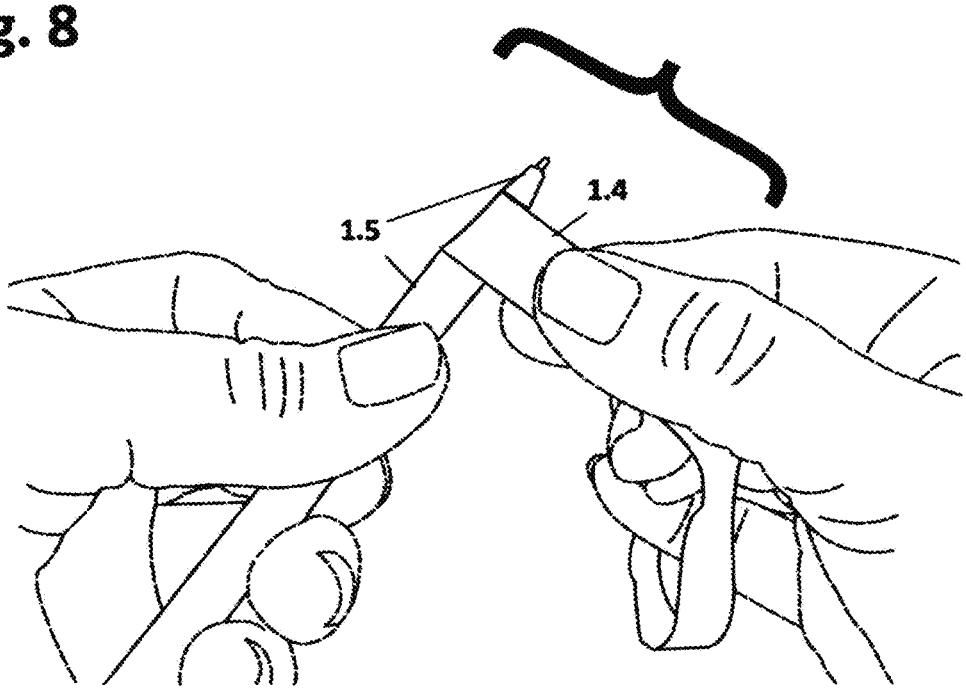
FIG. 8—A perspective view of step seven of process

FIG. 8—Step seven: Holding (1.5) ball point pen, begin wrapping (1.4) floral tape by starting with a straight line just below where the pen inserts into the pen tube. Leaving this area exposed will allow for completed pen plants ink to be replaced easily and without having to reassemble or replace entire plant section.

Figure 9:
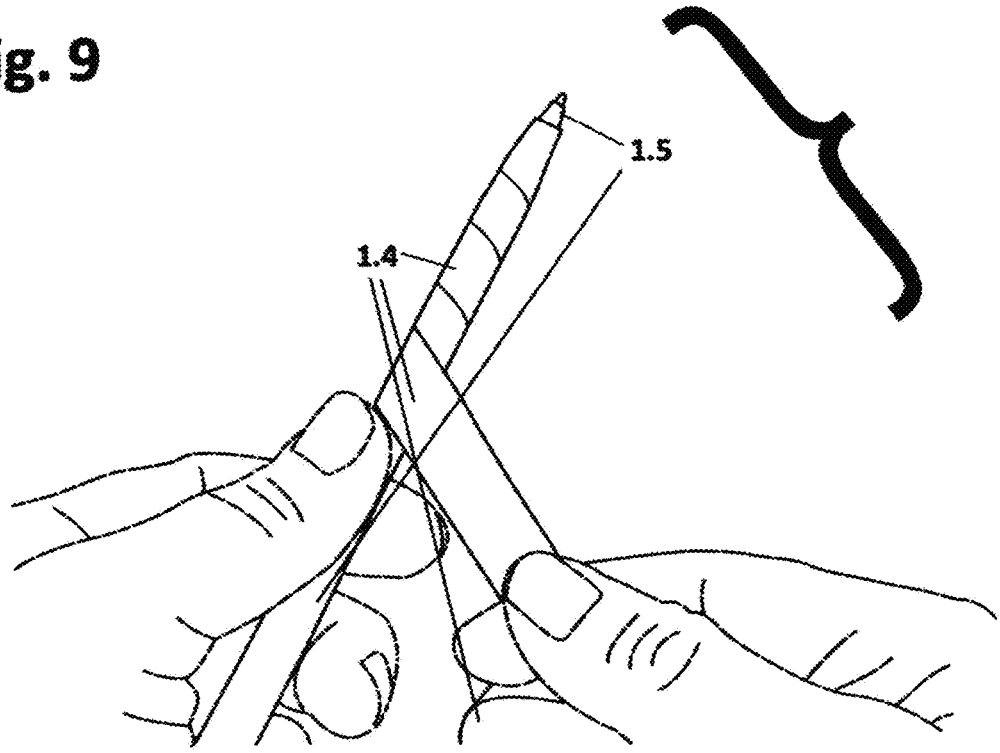
FIG. 9—A perspective view of step eight of process

FIG. 9—Step eight: Wrap (1.5) ball point pen with (1.4) floral tape starting in a vertical motion until the entire top of the start area is covered in a straight line. Gradually work the tape down the pen by slightly stretching and pinching the area until the spiral motion is consistent.

Figure 10:
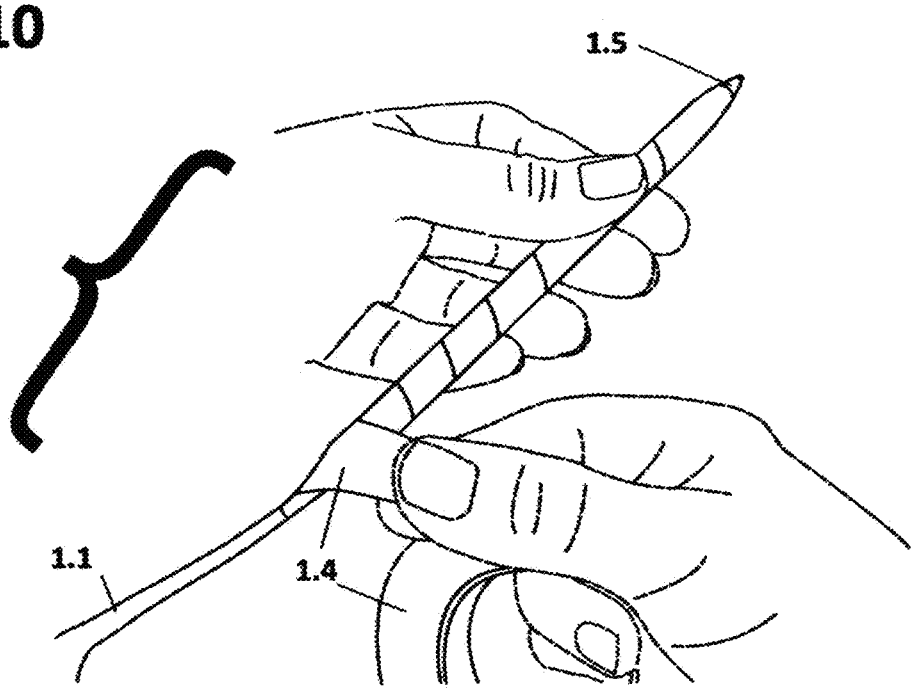
FIG. 10—A perspective view of step nine of process

FIG. 10—Step nine: Continue wrapping (1.5) ball point pen with (1.4) floral tape. Work your way down the pen until you reach the shoot where the (1.6) glue gun was used to blend the (1.7) glue into the (1.1) wired plants shoot. Wrap the shoot itself while gradually stretching the (1.4) floral tape until a vertical line is achieved on the shoot. Once the line is vertical start to work your spiral back up the (1.5) ball point pen while pinching the area smooth on the way up.

Figure 11:
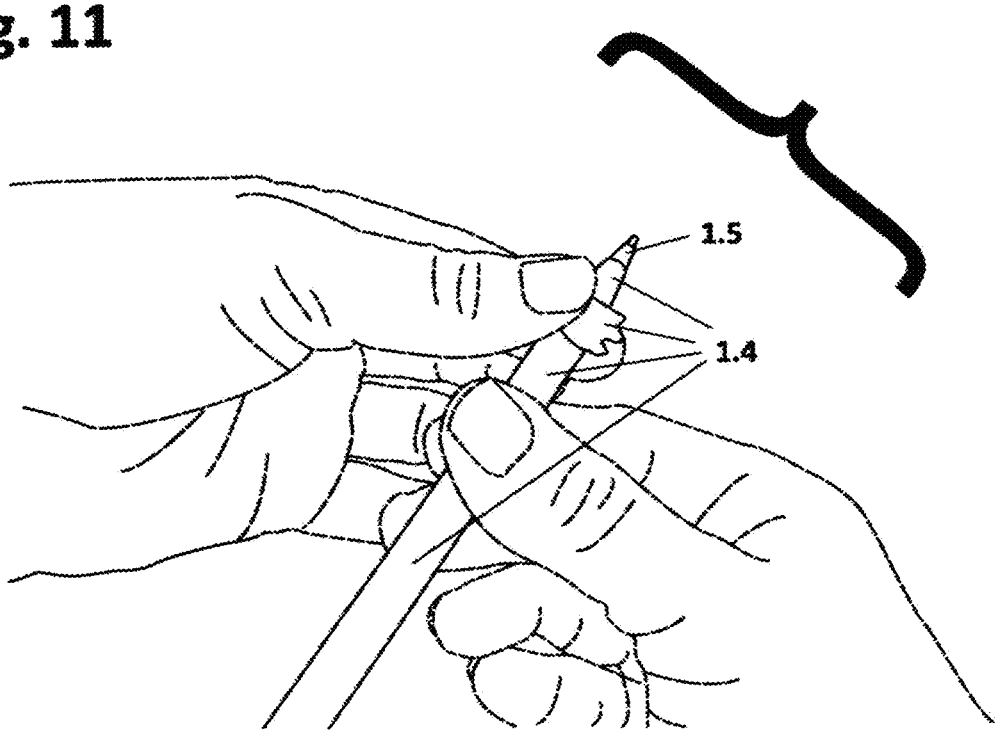
FIG. 11—A perspective view of step ten of process

FIG. 11—Step ten: When you reach the top of the (1.5) ball point pen, wrap and stretch the (1.4) floral tape back to the straight line you started with. Once the line is perfectly straight, stretch and pull the (1.4) floral tape down as if starting another spiral and break with fingers. This will give the (1.4) floral tape a rough edge that will better adhere to itself.

Figure 12:
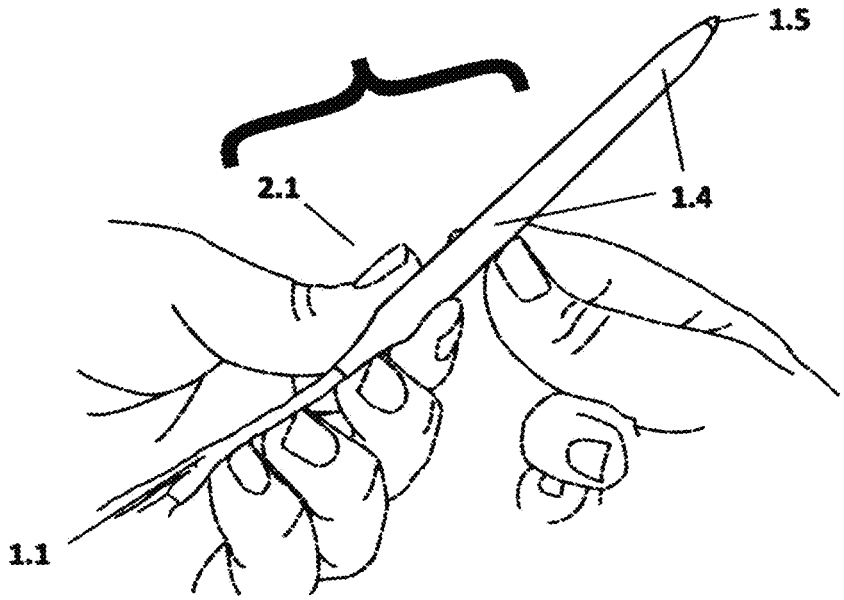
FIG. 12—A perspective view of step eleven of process

FIG. 12—Step eleven: Starting from the shoot of the (1.1) wired plant, roll and pinch the (1.4) floral tape with your fingers until the entire (1.5) ball point pen has been covered. This process will prevent the (1.4) floral tape from lifting.

Figure 13:
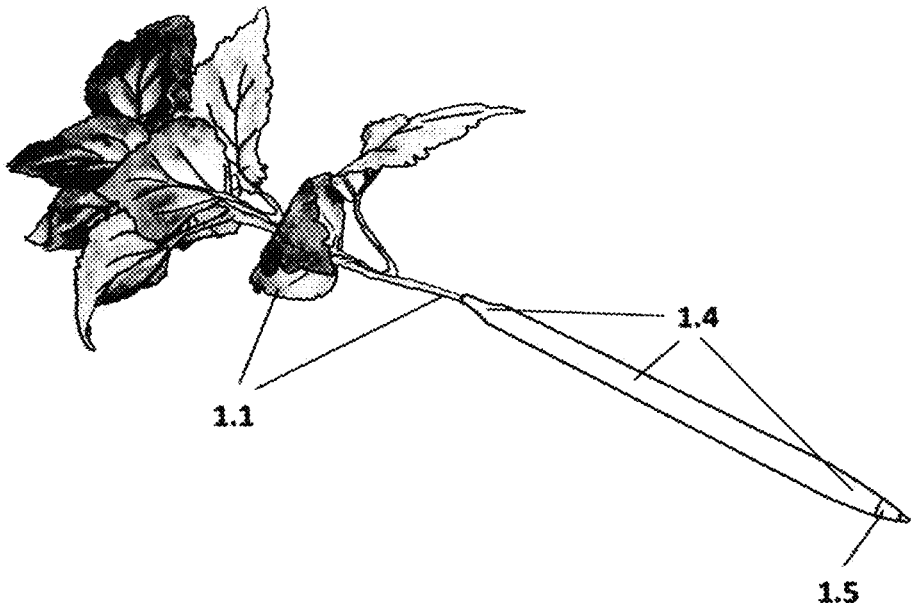
FIG. 13—A perspective view of step twelve of process

FIG. 13—Step twelve: Complete this process for all of the (1.1) plant shoots and allow them to cure for 24 hours. Once cured they will be hard enough to use consistently without damage. Cured pens are then placed into a vase with (1.8) beans to create the illusion of soil and a real house plant.

DETAILED DESCRIPTION OF PREFERRED EMBODIMENTS

As illustrated in FIGS. 1-13, the present invention is a wired artificial house 'Pen Plant' providing a specially designed line of artificial plants for use in creating any number of useful, and realistic house plants featuring a ball point pen incorporated into each shoot.

The 'Pen Plant' invention can be produced in a variety of wired artificial house plants in which some were pictured in my earlier application, Ser. No. 14/813726, Filed on July 31, 2015. The plants are wired so that they can be easily manipulated to create a variety of designs. Each plant design is realistic in size and color so the final product looks like a real plant, but each shoot comprised of a ball point pen can be utilized as a writing instrument. The Pen Plant can be sold to many business establishments, and to the general consumer.

Use of the artificial house 'Pen Plant' is simple, straight forward, useful and practical. Users simply purchase various size pen plants for the number of pens that suit their needs. For instance, a restaurant may order a two pen plant to display on each of their tables with a notepad with their restaurants website to offer for resale. A hotel may find a larger display useful at their check-in area for customers to use. They may place a variety of sizes in their gift shop for resale, or place one in each room with the option to buy it for additional profit. Small offices may purchase them for their employee's desks to reduce overhead. Alternately, companies may display them in various places throughout their establishment to reduce overhead, and add to their décor. As needed, the user removes individual shoots from the plant, utilizing the writing instrument implemented into it to record information, then returning it to the plant after use.

The 'Pen Plant' offers users a number of significant benefits and advantages. Foremost, the Pen Plant provides users a useful, practical, and beautiful decorative tool to use in their home or office. Elegantly designed to add a touch of class to any motif, the beautifully crafted plants incorporate a writing instrument, a ball point pen, to each shoot for quick access and easy arrangement.

Users will enjoy purchasing their favorite plant from the Pen Plant line to create a unique addition to any room of their home or office to have a writing instrument at hand. Well suited for business use; Pen Plants help to reduce overhead by providing customers a writing instrument with staying power, increase their profits and add elegance and uniqueness to their current motif while reducing theft.

The 'Pen Plant' is fun to use; users of all ages will enjoy writing with this these practical pens while giving them the feeling that they have just experienced something special. Everyone will want one of these beautiful displays.

Rather than companies wasting their money on imprinted pens with promotional advertising that never get read, the 'Pen Plant' will increase word of mouth, and have your customers talking about your establishment in no time. The 'Pen Plant' can be offered on a business website, sold in a gift shop or floral shop, displays and sold in hotel rooms, and restaurants. When the ink is depleted, individual replacements are available.

The 'Pen Plant' offers users a beautiful artificial plant with the convenience of a writing instrument in one simple to use product. Produced in a variety of plant types and designs, these beautiful 'Pen Plants' appeal to a wide variety of users.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art.

Moreover, the invention as disclosed herein may be suitably practiced in the absence of the specific elements which are disclosed herein.

The invention claimed is:

1. An artificial house plant comprising:

a pen having a pen tube with writing tip at a first end and an opening at a second end;

a wired artificial plant having a shoot at an end thereof wherein said shoot is inserted into said opening and secured therein with adhesive such that a portion of said shoot is positioned within said opening and portion of said shoot extends from said opening and such that a portion of said adhesive is positioned within said opening and a portion of said adhesive extends from said opening;

floral tape wrapped around said pen tube, said portion of said adhesive that extends from said opening and said portion of said shoot that extends from said opening wherein said floral tape extends from said writing tip, over said portion of said adhesive that extends from said opening and over a portion of said portion of said shoot that extends from said opening; and a vase having beans therein into which said pen is inserted whereby said beans create the illusion of soil.

* * * * *